US007547195B2

(12) United States Patent
Upadhye et al.

(10) Patent No.: US 7,547,195 B2
(45) Date of Patent: Jun. 16, 2009

(54) SCROLL COMPRESSOR WITH HIGH SIDE TO LOW SIDE OIL BLEED VALVE

(75) Inventors: Harshal Upadhye, Arkadelphia, AR (US); Gregory W. Hahn, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 11/861,329

(22) Filed: Sep. 26, 2007

(65) Prior Publication Data

US 2009/0081062 A1 Mar. 26, 2009

(51) Int. Cl.
*F04B 49/10* (2006.01)

(52) U.S. Cl. ..... 417/13; 417/228; 418/55.1; 418/270; 184/6.1; 184/6.4

(58) Field of Classification Search ..... 418/55.1–55.6, 418/57, 270, DIG. 1; 417/292, 310, 13, 228, 417/229, 230, 231; 184/6.1, 6.4, 6.16–6.18
See application file for complete search history.

(56) References Cited

U.S. PATENT DOCUMENTS

| | | | | |
|---|---|---|---|---|
| 5,174,740 | A | 12/1992 | Jang | |
| 5,248,244 | A * | 9/1993 | Ho et al. | 417/292 |
| 6,280,146 | B1 * | 8/2001 | Bush et al. | 417/13 |
| 6,485,268 | B1 * | 11/2002 | Hugenroth et al. | 417/228 |
| 6,648,607 | B2 * | 11/2003 | Milliff et al. | 417/13 |
| 6,848,889 | B2 * | 2/2005 | Hugenroth | 417/228 |
| 7,396,213 | B2 * | 7/2008 | Hugenroth | 417/13 |
| 2003/0035736 | A1 * | 2/2003 | Nam | 417/292 |

FOREIGN PATENT DOCUMENTS

| | | | | |
|---|---|---|---|---|
| EP | 1130265 | | 5/2002 | |
| JP | 03237286 | A * | 10/1991 | 418/55.6 |

* cited by examiner

*Primary Examiner*—Theresa Trieu
(74) *Attorney, Agent, or Firm*—Carlson, Gaskey & Olds

(57) ABSTRACT

A scroll compressor is provided with an oil bleed valve that selectively communicates a discharge pressure chamber to a suction pressure chamber. The oil bleed valve controls flow of hot oil through a passage and onto a safety shutoff switch for an electric motor.

5 Claims, 2 Drawing Sheets

SCROLL COMPRESSOR WITH HIGH SIDE TO LOW SIDE OIL BLEED VALVE

BACKGROUND OF THE INVENTION

This application relates to a scroll compressor wherein a temperature responsive valve controls an oil bleed from a high pressure chamber to a suction chamber, such that hot oil can be selectively delivered to a motor protection switch for the compressor motor.

Scroll compressors are becoming widely utilized in refrigerant compression applications. In a scroll compressor, a pair of scroll members each have a base and a generally spiral wrap extending from its base. The wraps interfit to define compression chambers. One of the two scroll members is caused to orbit relative to the other by an electric motor driving a shaft. As the two orbit, the size of the compression chamber decreases and an entrapped refrigerant is compressed.

In one known type of scroll compressor, the motor and the scroll members are received within a sealed housing shell. Some structure separates the interior of the sealed housing into a high pressure side and a suction pressure side. The refrigerant is delivered into the suction pressure side, and is allowed to pass over the electric motor cooling the electric motor. Historically, the separation of the interior of the housing shell into the two chambers was done by a separate separator plate. More recently the non-orbiting scroll member has been utilized to provide the separation between the two sides.

In scroll compressors having a separator plate, a technique was utilized wherein a temperature responsive valve selectively controlled the flow of oil onto a temperature sensitive safety switch for the electric motor. If the scroll compressor became too hot, the switch would open and hot oil would be allowed to drop onto the safety switch and the motor would stop. This prevents damage to the compressor when an undesirable occurrence, such as a loss of charge of refrigerant, occurs.

The prior art and its oil valve did not extend across the separator plate, and thus only returned oil from one portion of the suction pressure side to another portion. Oil which traveled with the refrigerant and into the discharge pressure chamber was not easily returned to the compressor sump, especially when there was a lesser charge of refrigerant, such in a loss of charge situation.

SUMMARY OF THE INVENTION

In a disclosed embodiment of this invention, an oil bleed valve is provided in the base of the non-orbiting scroll, and the non-orbiting scroll provides separation between the two chambers. Thus, the oil bleed valve communicates a high pressure chamber to a suction pressure chamber. Oil is thus returned from the discharge pressure chamber when the valve is opened. Moreover, the valve is preferably located in a radially outer "lower" area of the base of the non-orbiting scroll.

These and other features of the present invention can be best understood from the following specification and drawings, the following of which is a brief description.

DETAILED DESCRIPTION OF THE PREFERRED EMBODIMENT

Figure 1:
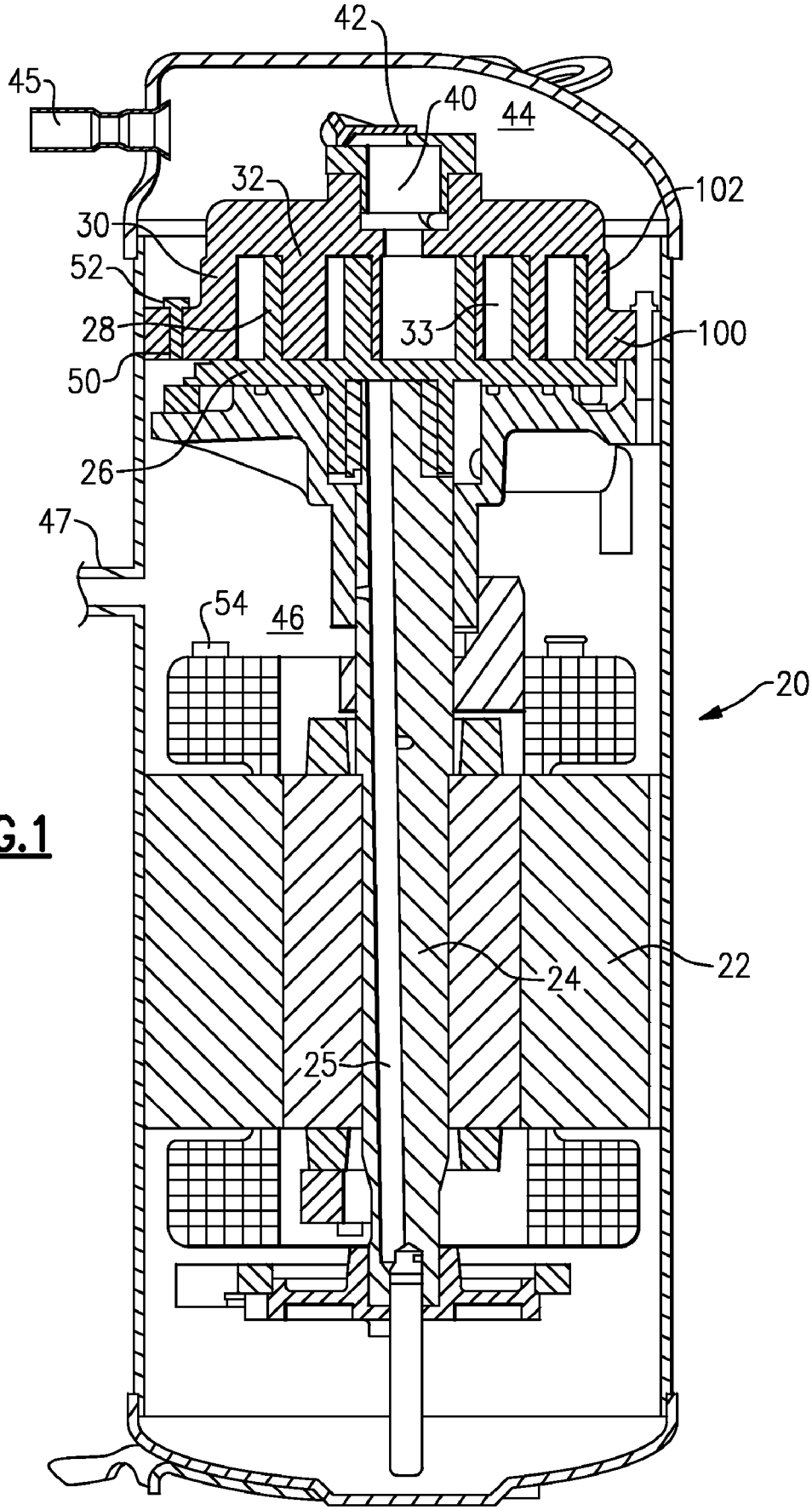
FIG. 1 is a cross-sectional view schematically showing the inventive scroll compressor.

FIG. 1 shows a scroll compressor 20 having an electric motor 22 driving a shaft 24. As known, the shaft 24 includes an oil supply line 25 supplying the oil upwardly into an orbiting scroll member 26 having a wrap 28, and a non-orbiting scroll member 30 having a wrap 32. As known, the wraps 28 and 32 define compression chambers 33. Refrigerant is trapped in the compression chambers and compressed toward a discharge port 40, and through a check valve 42 to a discharge tube 45 communicating the refrigerant to a downstream refrigerant system. The chamber 44 is at a high pressure, and a chamber 46 on the opposed side of the non-orbiting scroll 30 is at suction pressure. Refrigerant is returned to a suction tube 47 from a downstream refrigerant system. This suction refrigerant passes over the motor 22, to cool the motor.

Figure 2:
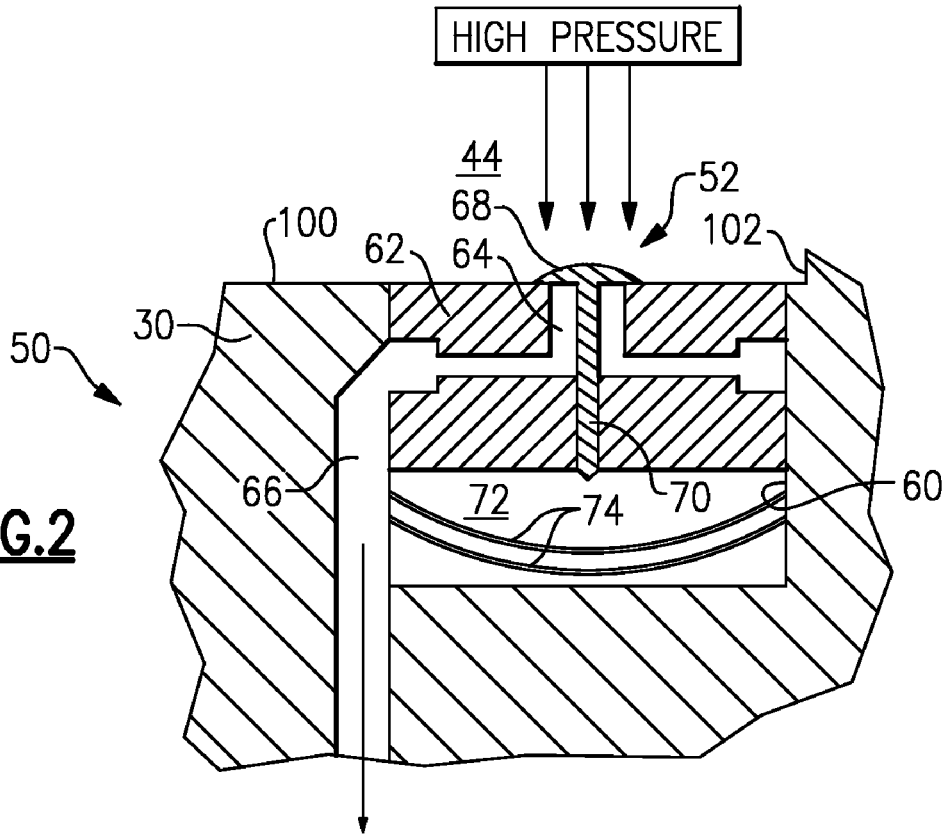
FIG. 2 is an enlarged view of the inventive oil bleed valve.

A safety system 50 is shown with a oil bleed valve 52, somewhat schematically in this figure. As shown in FIG. 2, a chamber 60 receives a valve housing 62 having an opening 64 receiving a valve poppet 68. A passage 66 communicates hot oil downwardly onto a safety switch 54. When the valve poppet 68 is opened, hot oil will travel onto the switch 54, and the switch will stop operation of the motor 22. This prevents operation of the motor when conditions become unduly hot.

As shown in FIG. 2, the valve poppet 68 has a stem 70 which is guided for reciprocal movement in the valve housing 62. A chamber 72 receives bi-metal discs 74 which pop between the position illustrated in FIG. 2, and the position illustrated in FIG. 3, once the temperature applied to the bi-metal discs 74 by the non-opening scroll 30 passes a particular point. Thus, should conditions become unduly hot, the bi-metal discs 74 snap to the position shown in FIG. 3, and the valve poppet 68 is forced upwardly, creating a passage 80, to allow hot oil to move into the passage 66, and return back downwardly into the sump of the compressor 20. In this manner, oil is returned to the compressor sump when conditions are unfavorable, such as in a loss of charge situation. Moreover, the oil will also serve to shutdown the compressor under such conditions.

Figure 3:
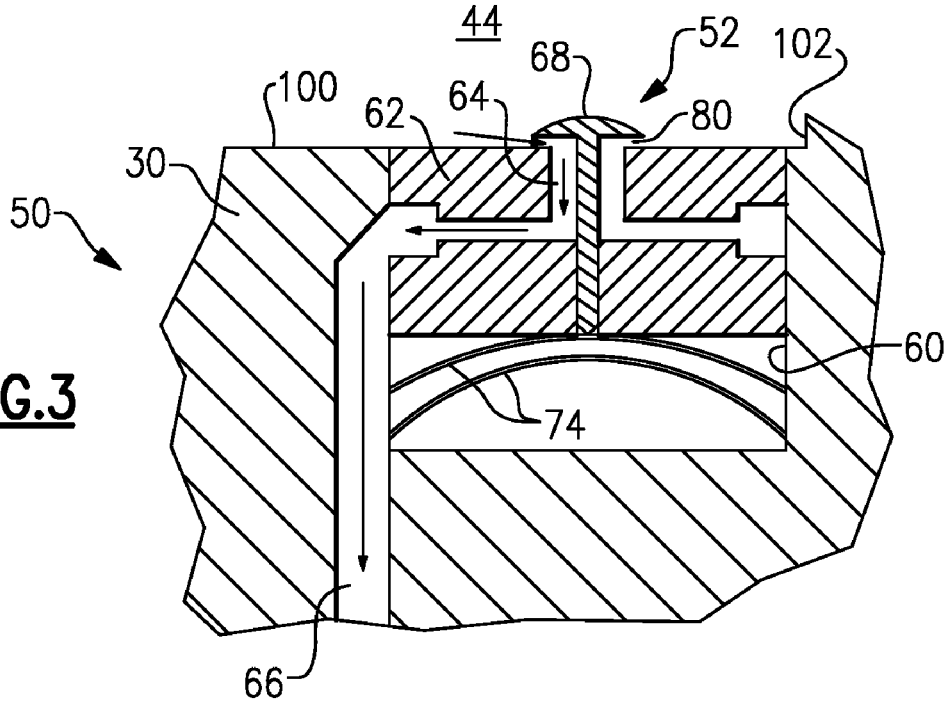
FIG. 3 is another view of the inventive oil bleed valve.

As can be appreciated from FIGS. 1, 2 and 3, the system 50 and the valve 52 are formed in a radially outer portion 100 of the non-orbiting scroll 32 which is vertically lower than more central portions 102. Thus, oil will tend to collect in the location of the valve 52 and passage 50.

While an embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a sealed housing shell;

an electric motor received within said sealed housing shell, said electric motor driving a shaft, said shaft causing an orbiting scroll member to orbit, said orbiting scroll member having a spiral wrap interfitting with a spiral wrap on a non-orbiting scroll member to define compression chambers to compress an entrapped refrigerant, said non-orbiting scroll member being received said housing shell in a sealed manner, and defines a suction pressure chamber on one side of said non-orbiting scroll and a discharge pressure chamber on an opposed side, with said orbiting scroll and said motor received within said suction pressure chamber, a check valve upstream of said discharge pressure chamber, and said check valve being downstream of said compression chambers; and an oil bleed valve for selectively opening a passage through said non-orbiting scroll and communicating said discharge pressure chamber to said suction pressure chamber, said oil bleed valve including a component which moves between an open and closed position when a temperature passes a predetermined limit, and said passage allowing hot oil to move downwardly onto a safety switch for said electric motor to stop operation of said electric motor when said oil bleed valve is opened.

2. A scroll compressor as set forth in claim 1, wherein said bleed valve is located at radially outer portion which is at a vertically lower level of the discharge pressure chamber.

3. The scroll compressor as set forth in claim 1, wherein said oil bleed valve including a bi-metal member which snaps between an actuated and an unactuated position when the predetermined limit is reached, and said bi-metal member forcing said oil bleed valve to an open position when actuated.

4. The scroll compressor as set forth in claim 3, wherein said bi-metal member is in a suction pressure chamber.

5. The scroll compressor as set forth in claim 1, wherein said oil bleed valve is located in said non-orbiting scroll member.

* * * * *